US007483255B2

(12) United States Patent
Gefter et al.

(10) Patent No.: US 7,483,255 B2
(45) Date of Patent: Jan. 27, 2009

(54) IONIZING ELECTRODE STRUCTURE AND APPARATUS

(75) Inventors: Peter Gefter, So. San Francisco, CA (US); Scott Gehlke, Berkeley, CA (US); John K. O'Reilly, San Francisco, CA (US)

(73) Assignee: Ion Systems, Alameda, CA (US)

( * ) Notice: Subject to any disclaimer, the term of this patent is extended or adjusted under 35 U.S.C. 154(b) by 54 days.

(21) Appl. No.: 11/353,760

(22) Filed: Feb. 13, 2006

(65) Prior Publication Data

US 2006/0176641 A1 Aug. 10, 2006

Related U.S. Application Data

(63) Continuation-in-part of application No. 10/459,865, filed on Jun. 11, 2003, now Pat. No. 7,339,778.

(51) Int. Cl.
*H01H 50/12* (2006.01)

(52) U.S. Cl. ..... 361/213; 361/212

(58) Field of Classification Search ..... 361/212–214, 361/220–222

See application file for complete search history.

(56) References Cited

U.S. PATENT DOCUMENTS

| | | | | |
|---|---|---|---|---|
| 2,965,481 | A | 12/1960 | Gundlach | |
| 3,075,078 | A | 1/1963 | Olden | |
| 3,706,938 | A * | 12/1972 | Petriw | 324/459 |
| 3,770,972 | A | 11/1973 | Hastwell | |
| 3,777,158 | A | 12/1973 | Kamogawa et al. | |
| 3,996,795 | A * | 12/1976 | Servassier | 73/861.09 |
| 4,027,201 | A | 5/1977 | Bacon et al. | |
| 4,130,852 | A | 12/1978 | Peffer et al. | |
| 4,227,234 | A | 10/1980 | Seanor et al. | |
| 4,333,123 | A * | 6/1982 | Moulden | 361/213 |
| 4,345,478 | A * | 8/1982 | Barat | 73/861.09 |
| 4,740,862 | A | 4/1988 | Halleck | |
| 4,941,353 | A * | 7/1990 | Fukatsu et al. | 73/504.05 |
| 5,006,761 | A * | 4/1991 | Torok et al. | 315/111.91 |
| 5,153,811 | A | 10/1992 | Rodrigo et al. | |
| 5,424,103 | A | 6/1995 | Ahn | |
| 5,469,242 | A | 11/1995 | Yu et al. | |
| 5,540,761 | A * | 7/1996 | Yamamoto | 96/67 |
| 5,627,376 | A | 5/1997 | Jaisinghani et al. | |
| 5,672,871 | A | 9/1997 | Jacobs et al. | |
| 5,891,409 | A | 4/1999 | Hsiao et al. | |
| 6,038,120 | A | 3/2000 | May et al. | |
| 6,086,675 | A | 7/2000 | Hamamoto et al. | |
| 6,436,170 | B1 * | 8/2002 | McDermott et al. | 95/58 |
| 6,943,347 | B1 * | 9/2005 | Willoughby et al. | 250/288 |
| 2003/0039485 | A1 | 2/2003 | Yoshiyama | |

OTHER PUBLICATIONS

PCT International Search Report and Written Opinion, PCT/US06/12762, Sep. 21, 2007, 11 pages.

* cited by examiner

*Primary Examiner*—Danny Nguyen
(74) *Attorney, Agent, or Firm*—Fenwick & West LLP

(57) ABSTRACT

Ions for neutralizing electrostatic charge on an object are generated and delivered in a stream of gas flowing through a dielectric channel that surrounds a loop of conductive filament which forms an ionizing electrode. The loop is formed within a single plane, or within multiple planes, and is supported within the channel with a plane of the loop substantially aligned with flow of gas through the channel. A region of minimum field intensity within the bounded region of the loop electrode is oriented in alignment with substantially maximum velocity of gas flow through a cross section of the dielectric channel.

17 Claims, 5 Drawing Sheets

IONIZING ELECTRODE STRUCTURE AND APPARATUS

RELATED APPLICATION

This application claims benefit under 35 U.S.C. § 120 as a continuation-in-part of application Ser. No. 10/459,865, filed on Jun. 11, 2003 now U.S. Pat. No. 7,339,778 by P. Gefter et al, which application is incorporated herein in the entirety by this reference thereto.

FIELD OF THE INVENTION

This invention relates to air or gas ionizing electrodes and more particularly to apparatus for neutralizing electrostatic charge on an object by efficiently generating and collecting ions for delivery to the object in a flowing gas stream and in a low-maintenance manner.

BACKGROUND OF THE INVENTION

Electrode structures for generating ions of one or other polarity commonly rely upon sharp pointed electrodes or small diameter stretched filaments for creating a corona discharge in response to an applied high ionizing voltage.

However, ions generated in this manner are strongly influenced by a high intensity electrical field near the electrode surface that controls ion movement and reduces the effectiveness of a flowing gas stream to capture, collect and deliver ions to the charged object.

Moreover, pointed electrodes and filament electrodes are prone to deposit on the electrode surfaces byproducts of corona discharge in the gas stream. These deposits of byproducts create instability of corona discharge, reduce ion generation and disrupt ion balance in the gas stream.

SUMMARY OF THE INVENTION

In accordance with one embodiment of the present invention, a conductive filament is formed as a loop that is supported within a nozzle for a stream of flowing gas and that is connected to a source of high ionizing voltage.

The filament is formed from electrically conductive material, for example, such as tungsten or hastelloy alloy. The diameter of the filament ranges from about 10 to about 100 microns, and preferably is about 30-60 microns. The filament may have surface coating of corrosion-resistant materials in one or more layers that may be electrically conductive or non-conductive. For example, the surface coating may be glass or ceramic or metal or metal alloy.

The loop electrode may be formed in a flat two-dimensional or three-dimensional configuration and may have round or elliptical or semi-elliptical shape with various ratios of major and minor axes.

The loop electrode may be positioned in close proximity to a non-ionizing electrode and may be disposed in a flowing gas stream to move the generated ions and slow down the formation of corona byproducts. The gas may be an inert gas such as argon, or a low-moisture gas such as nitrogen or clean dry air (CDA).

Various configurations of the loop electrode, the support structure and the non-ionizing electrode are arranged to maximize interaction between generated ions and the flowing gas stream to enhance ions collection for delivery to a charged object.

In accordance with one embodiment of the present invention, two ionizing electrodes are each configured as a loop that is immersed in a flowing gas stream and is connected individually to one of positive and negative high voltage power supplies for optimized ion generation and ion collection. In accordance with one embodiment of the present invention the ionizing electrode is configured as a loop that is immersed in a flowing gas stream and is connected to AC high voltage power supply operating at a voltage and frequency that are preset to optimize ion generation and ion collection.

DETAILED DESCRIPTION OF THE INVENTION

Figure 1A:
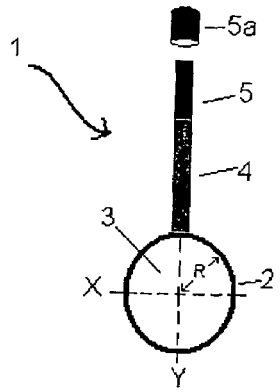
FIG. 1A is a plan view of one embodiment of the ionizing electrode according to the present invention in which a round loop is supported by a ceramic tube and is conductively connected to a high voltage terminal.

Referring now to FIG. 1A, there is shown a plan view of one embodiment of the present invention in which ionizing electrode 1 includes a conductive filament 2 in the form of a flat, round loop 3 having radius R. The loop radius may be in the range 0.1-50 mm, preferably, in the range 0.5-10 mm.

The loop 3 is supported by a dielectric structure, for example, ceramic tube 4 and is connected through a conductor in the dielectric structure to terminal 5 that forms an appropriate support and connection to socket 5*a* that is connected to a supply of high ionizing voltage.

Figure 1B:
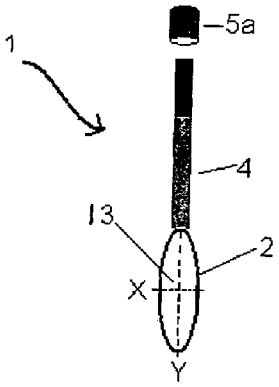
FIG. 1B is a plan view of one embodiment of the ionizing electrode according to the present invention in which an elliptical two-dimensional loop is supported by a ceramic tube and is conductively connected to a high voltage terminal.

Similarly, in the embodiment of FIG. 1B the filament 2 is formed as an elliptical two-dimensional loop lying within a plane. The elliptical configuration of the loop 13 is a suitable form for an ionizing electrode 1 positioned inside a confined space such as a tube or channel for confining a stream of flowing gas.

Figure 1C:
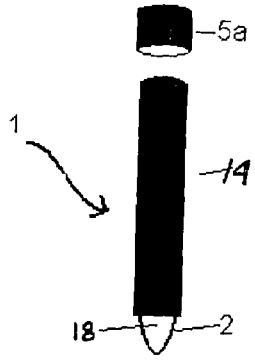
FIG. 1C is a plan view of one embodiment of the ionizing electrode according to the present invention in which a semi-elliptical loop is supported by a conductive tube for connection to a high voltage terminal.

In the embodiment of FIG. 1C the filament 2 is configured as a semi-elliptical flat loop 18 as a suitable shape for an ionizing electrode 1 supported by a conductive structure 14 inside a confined space such as an outlet nozzle for release of gas under pressure above ambient.

Figure 2A:
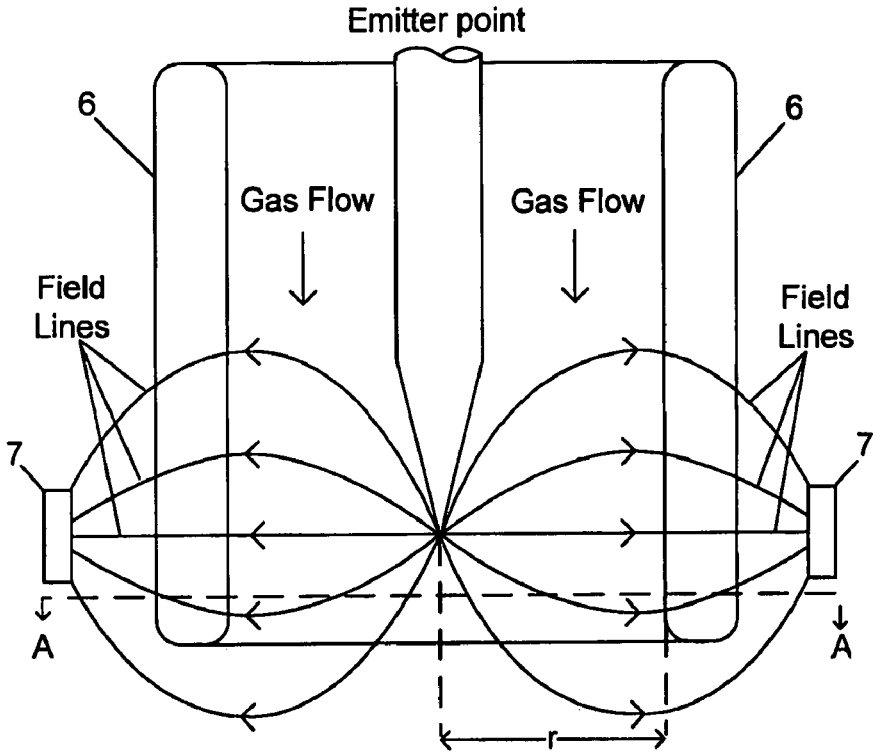
FIGURE 2A (PRIOR ART)
FIG. 2A is a pictorial view of a typical pattern of electrical field lines associated with a conventional pointed electrode positioned inside a dielectric tube.

Referring to the pictorial view of FIG. 2A there is shown as conventional pointed ionizing electrode positioned inside a dielectric tube 6 of radius r that confines a flowing gas. Also shown is a simplified picture of electrostatic field lines distributed between the pointed electrode and the reference electrode 7.

Figure 2B:
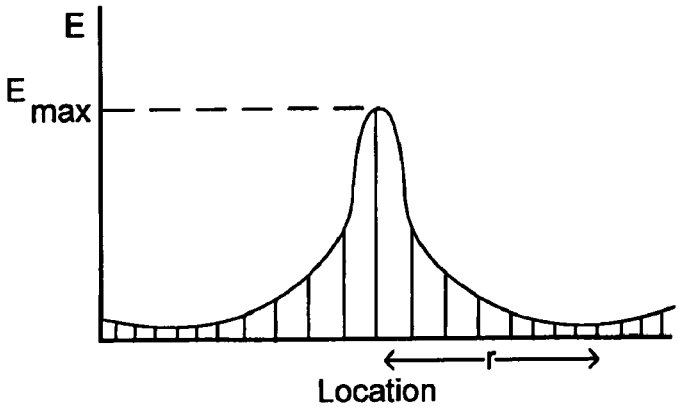
FIGURE 2B (PRIOR ART)
FIG. 2B is a simplified graph of electrostatic field intensity distribution for the conventional pointed electrode of FIG. 2A.
Figure 2C:
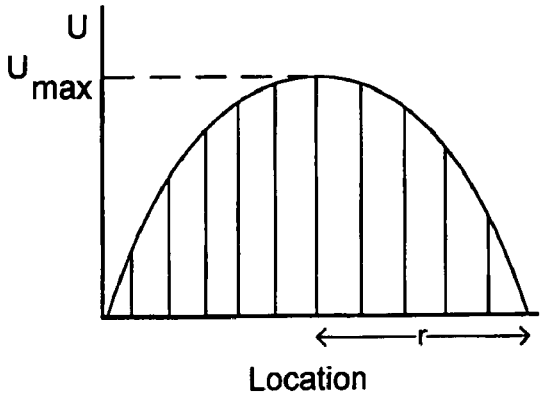
FIGURE 2C (PRIOR ART)
FIG. 2C is a simplified graph of gas velocity distribution through a cross section of the dielectric tube of FIG. 2A.

Referring to FIG. 2B there is shown a plot of electrical field intensity E distribution in cross section A-A of FIG. 2A. High voltage applied to the pointed electrode creates maximum field intensity E max near the tip or point of the electrode that is positioned in the middle of dielectric tube 6 and that is surrounded by reference electrode 7. The tube confines a gas stream for moving ions away from the pointed electrode. As illustrated in FIG. 2C which is a plot of flowing gas velocity across the diameter of tube 6 at cross section A-A, the maximum of the field intensity E coincides with the maximum flowing gas velocity U max in the central region of the tube. Ion generation is concentrated in the small volume around the tip of the electrode and such generated ions are trapped in a strong electrical field around that location. These conditions promote inefficient collection and delivery of generated ions within the stream of flowing gas.

Figure 3A:
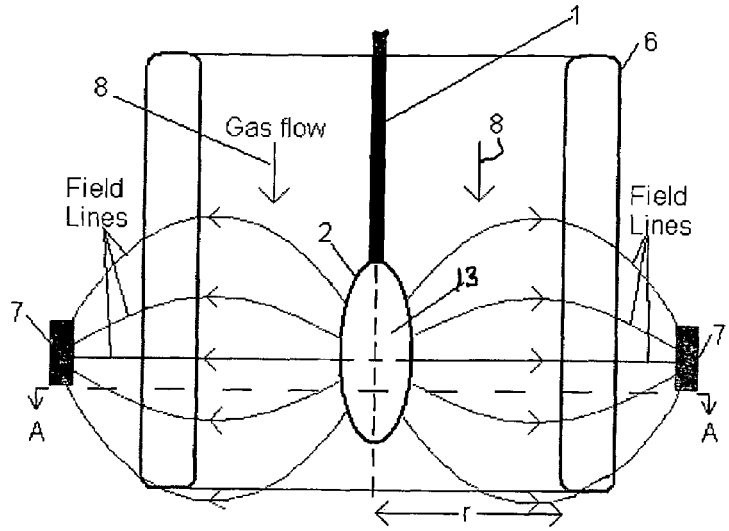
FIG. 3A is a pictorial view of electrical field lines for one embodiment of the present invention in which the filament loop electrode is positioned inside a dielectric tube that confines gas flow therethrough.

Referring now to FIG. 3A there is shown one embodiment of the present invention in which an elliptical loop 13 forming ionizing electrode 1 is positioned inside a dielectric tube 6 that confines a flowing gas stream 8. Also in FIG. 3B there is shown a simplified picture of electrostatic field lines between the filament loop electrode 13 inside the dielectric tube 6 and the non-ionizing electrode 7 disposed outside the dielectric tube 6.

Figure 3B:
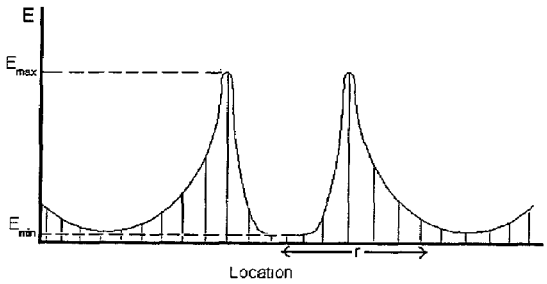
FIG. 3B is a simplified graph of electrostatic field intensity distribution for the filament loop electrode positioned inside the dielectric tube in the embodiment of FIG. 3A.
Figure 3C:
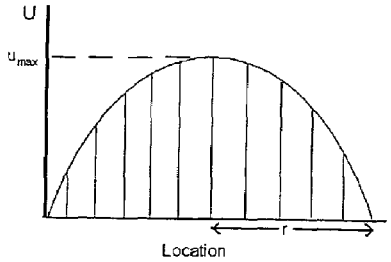
FIG. 3C is a simplified graph of gas velocity distribution inside the dielectric tube of FIG. 3A.

According to Gauss's law, electric field intensity E is primarily concentrated about the outer dimensions of the loop conductor 2 (see FIG. 3A) operating at high voltage, as shown in the plot of FIG. 3B, with minimal electric field intensity Emin distributed within the bounds of the loop 13. As illustrated in FIG. 3C which is a plot of flowing gas velocity across the diameter of tube 6 at cross section A-A, the maximum gas velocity near the center of tube 6 coincides with location of minimum field intensity Emin. The near-maximum gas velocities about the center of tube 6 coincide with locations of maximum field intensities. Thus, ions generated about the looped filament conductor 2 are able to migrate toward the interior volume of loop 13 that exhibits low field intensity, and are maximally generated about the loop conductor 2, all in locations of maximum or near-maximum gas flow velocity within dielectric tube 6. These conditions promote highly efficient capture or collection and delivery of generated ions within the flowing gas stream (for example, toward a charged object to be neutralized, not shown).

The loop electrode embodiment of the present invention as illustrated in FIG. 3A thus effectively establishes large surface area for the generation and collection of ions within a stream of gas flowing past the loop electrode. Ions may diffuse or otherwise migrate toward the central region of low field intensity within the bounds of the loop electrode 2 for efficient collection and delivery within the central region of the gas stream that exhibits maximum flow velocity. And, the large emitting area of the loop electrode promotes lower current density per unit length along the loop conductor 2 with concomitant reduction in erosion of the conductor 2.

Figure 4A:
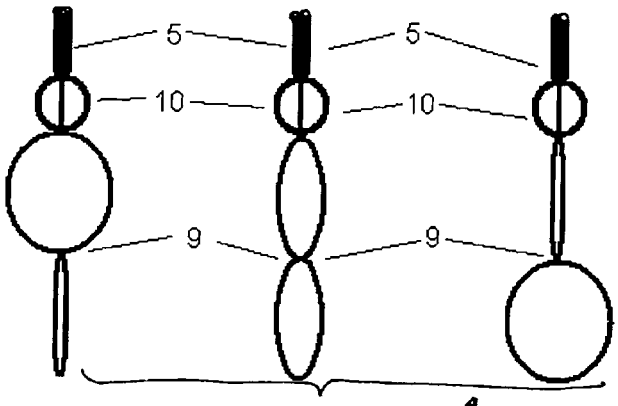
FIG. 4A is a plan view illustrating different angular orientations of one embodiment of an ionizing electrode according to the present invention in which an elliptical three-dimensional loop electrode is supported by a glass bead for conductive connection to a high voltage terminal.
Figure 4B:
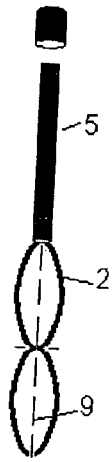
FIG. 4B is a plan view of one embodiment of the ionizing electrode according to the present invention in which an elliptical three-dimensional loop is supported on a conductive tube for connection to a high voltage terminal.

Referring now to FIG. 4A, there are shown separate angular orientations about a central axis of a looped filament electrode 9 that is configured as a three-dimensional loop with portions disposed in separate, skewed planes. This configuration exposes large surface areas of the loop filament 9 to a gas stream flowing past the conductor 9. The loop filament 9 is connected to a supporting electrical terminal 5 and is spaced therefrom by dielectric bead 10. Alternatively, as shown in FIG. 4B, the loop filament 9 may be directly attached to and supported by the conductive terminal 5 that also serves as a high voltage electrode.

Figure 5A:
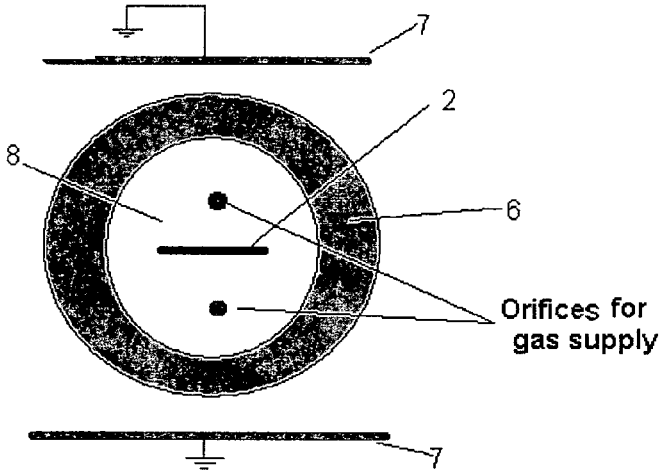
FIG. 5A is a sectional view of one embodiment of the ionizing electrode according to the present invention in which an elliptical two-dimensional loop electrode is positioned inside a dielectric tube and non-ionizing electrodes are positioned parallel to the plane of the loop electrode.

Referring now to FIG. 5A there is shown a sectional view of one embodiment in which ionizing electrode 2 is configured as the elliptical, two-dimensional loop that is positioned within a dielectric tube 6 which confines a flowing stream of air or gas 8. Non-ionizing planar reference electrodes 7 are positioned outside the tube 6 and are oriented, for example, parallel to the plane of the loop electrode 2.

Ions generated by the loop ionizing electrode 2 are collected by flowing gas 8 passing through orifices 8 for delivery to a charged object (not shown). The gas 8 may be low-moisture dry clean air (CDA), nitrogen or a mix of gases for reducing formation of corona byproducts on the loop electrode 2.

Figure 5B:
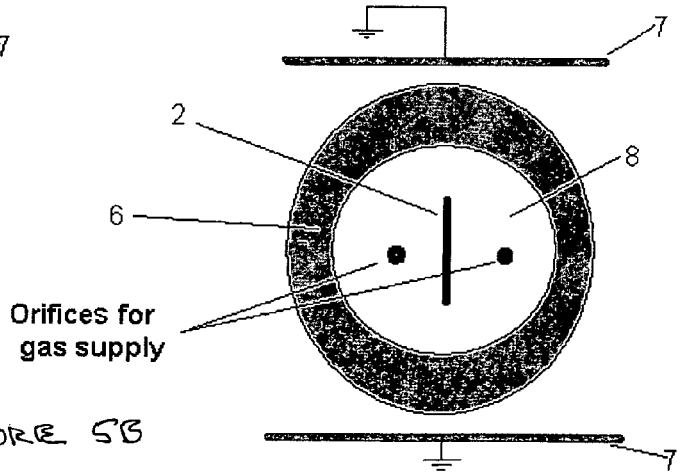
FIG. 5B is a sectional view of one embodiment of the ionizing electrode according to the present invention in which an elliptical two-dimensional loop electrode is positioned inside a dielectric tube and non-ionizing electrodes are positioned perpendicular to the plane of the loop electrode.

Alternatively, as shown in the sectional view of FIG. 5B, the planar, non-ionizing reference electrodes 7 are positioned outside the tube 6 perpendicular to the plane of the loop electrode 2. Of course, the reference electrode 7 in each of the described embodiments may also be configured as a ring, or portions thereof, disposed about the outer periphery of dielectric tube 6.

Figure 6A:
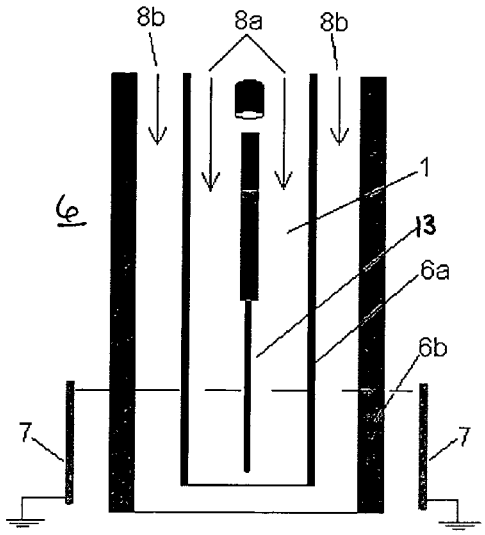
FIG. 6A is a sectional view of one embodiment of the ionizing electrode according to the present invention in which an elliptical flat loop electrode is positioned inside two concentric tubes and non-ionizing electrode are disposed parallel to the plane of the loop electrode.

Referring now to FIG. 6A, there is shown a sectional view of one embodiment of the ionizing electrode 1 in which an elliptical flat loop electrode 13 is positioned inside a gas nozzle 6 comprising two concentric tubes 6*a* and 6*b*. A non-ionizing or reference electrode 7 is positioned parallel to the plane of the loop electrode 13. Gas 8 flowing in tube 6*a* may be different from gas flowing in tube 6*b*. For example, gas in tube 6*a* may be nitrogen 8*a* and gas flowing in tube 6*b* may be clean dry air 8*b*. Gas velocity and gas consumption in tube 6*a* and in tube 6*b* may be different. In this embodiment, the consumption of more expensive gas 8*a* may be minimized.

Figure 6B:
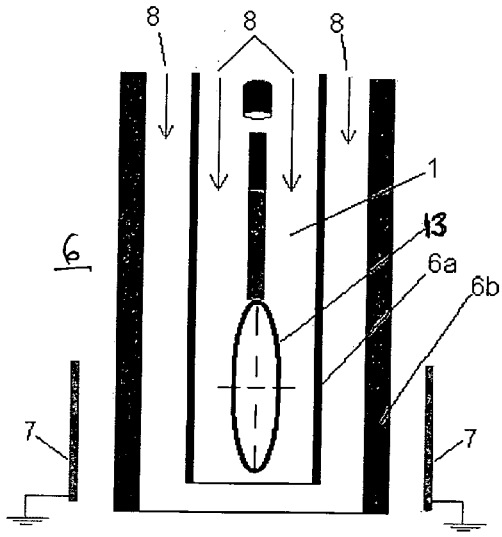
FIG. 6B is a sectional view of one embodiment of the ionizing electrode according to the present invention in which a flat elliptical loop electrode is positioned inside two concentric tubes and non-ionizing electrodes are positioned perpendicular to the plane of the loop electrode.

Alternatively, as shown in the sectional view of FIG. 6B, the ionizing loop electrode 13 is positioned inside the nozzle 6 and the non-ionizing electrode 7 is disposed perpendicular the plane of the loop electrode 13. Of course, the reference electrode 7 may also be configured as a ring, or portions thereof, disposed about the outer periphery of outer tube 6*b*.

Figure 6C:
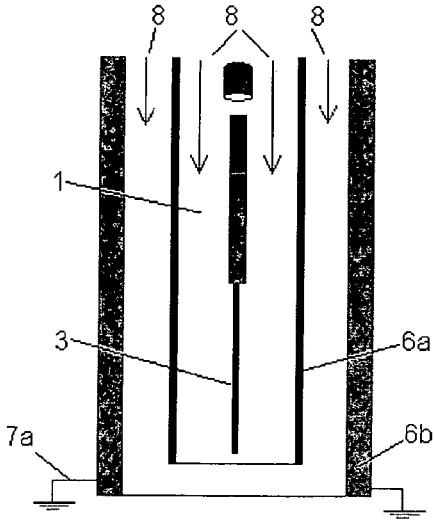
FIG. 6C is a sectional view of one embodiment of the ionizing electrode according to the present invention in which a flat elliptical loop electrode is positioned inside two concentric tubes and in which the outer tube is a conductive, non-ionizing electrode.

Referring now to FIG. 6C, there is shown a sectional view of one embodiment of the ionizing electrode 1 in which the flat elliptical loop electrode 13 is positioned inside two concentric tubes 6*a* and 6*b* of different materials. The outer tube 6*b* is conductive and serves as a non-ionizing reference electrode 7*a*, and the inner tube 6*a* is formed of dielectric material.

Figure 7A:
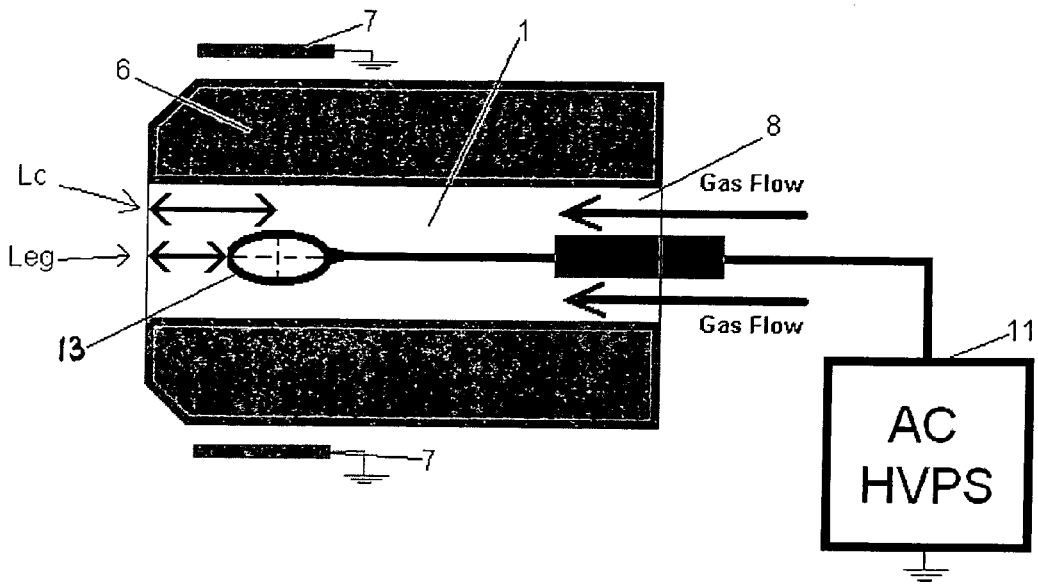
FIG. 7A is a sectional view of one embodiment of the ionizing electrode according to the present invention in which a two-dimensional elliptical loop electrode is connected to receive AC ionizing voltage and is positioned inside a dielectric tube with non-ionizing electrodes positioned perpendicular to the loop electrode.

Referring now to FIG. 7A there is shown a sectional view of one embodiment of the ionizing loop electrode in which the two-dimensional elliptical loop electrode 13 is connected to high AC ionizing voltage source 11 and is positioned inside dielectric tube 6 that confines a flowing gas 8. The planar non-ionizing electrode 7 is disposed outside the dielectric tube 6 perpendicular to the plane of the loop electrode 13. Of course, the reference electrode may be configured as a ring, or portions thereof, disposed about the outer periphery of tube 6.

The distal edge of the filament loop 13 is recessed $L_{eg}$ relative to the orifice or distal end of the nozzle 6, or is recessed $L_c$ between the center of the loop 13 and the orifice of the nozzle. The recess $L_{eg}$ may be in the range (+)5-(−) 10 mm, preferably (+)1-(−)5 mm. "Positive recess" as used herein means that the distal edge of the loop 13 protrudes or is positioned outside the nozzle 6 and may be exposed to ambient air or gas. "Negative recess" as used herein means that the distal edge of the loop 13 is retracted or is positioned inside the nozzle 6.

Figure 7B:
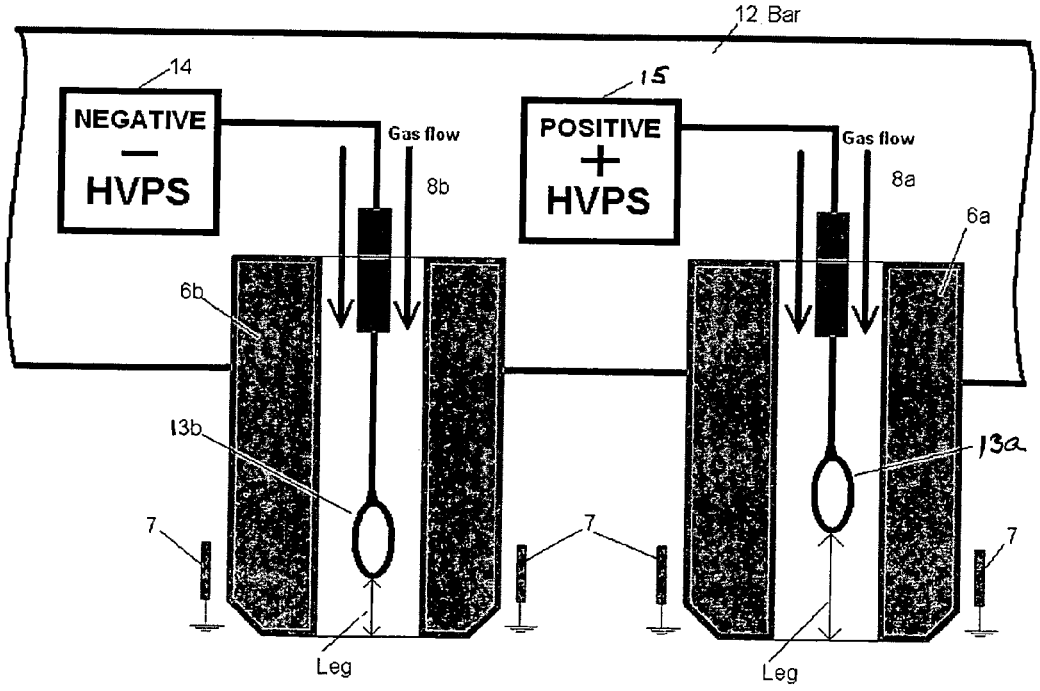
FIG. 7B is a sectional view of one embodiment of apparatus according to the present invention in which an ionizing bar includes two elliptical two-dimensional loop electrodes positioned inside dielectric tubes and are connected separately to sources of positive and negative ionizing voltage.

Referring now to FIG. 7B there is shown a sectional view of one embodiment of ionizing electrodes according to the present invention assembled in apparatus such as an ionizing bar 12 comprising at least two elliptical loop electrodes 13*a* and 13*b* separately connected to positive and negative high voltage power supplies 14, 15, with each electrode positioned inside a dielectric nozzle 6*a*, 6*b* that confines a flowing gas 8*a* and 8*b*. The recesses $L_{eg}$ of the loop electrodes 13*a* and 13*b* may be different. For example, the recess $L_{eg}$ for negative-voltage electrode 13*b* may be smaller than the recess $L_{eg}$ for positive-voltage loop electrode 13*a*. Also, the gas 8*b* flowing in the nozzle 6*b* may be different from gas 8*a* flowing in the nozzle 6*a*, or may flow at a different velocity. For example, the gas 8*a* may be clean dry air and gas 8*b* may be nitrogen. Generation of negative ions in nitrogen is more efficient with small recess $L_{eg}$. In this way, a desirable ion balance between generation of positive and negative ions can be achieved through combinations of two different recesses and compositions of two different gases flowing in the separate nozzles at different velocities.

Therefore, the ionizing electrodes of the present invention promote efficient generation of ions that can be readily captured in a stream of flowing gas for delivery to a charged object to be neutralized of static charge.

What is claimed is:

1. Ion-forming apparatus including an ionizing electrode comprising:

a conductive filament forming the ionizing electrode configured as an elliptical loop devoid of conductive elements within the loop;

a support for the filament including a conductive connection thereto for applying high ionizing voltage;

a dielectric channel including walls surrounding the conductive filament for confining a stream of flowing gas about the filament in a direction substantially aligned with a major axis of the elliptical loop; and a reference electrode disposed outside the dielectric channel near the elliptical loop of conductive filament along a direction aligned with a minor axis of the loop.

2. Ion-forming apparatus including an ionizing electrode comprising:

a conductive filament forming the ionizing electrode configured as an elliptical loop devoid of conductive elements within the loop;

a support for the filament including a conductive connection thereto for applying high ionizing voltage;

a dielectric channel including walls surrounding the conductive filament for confining a stream of flowing gas about the filament in a direction substantially aligned with a major axis of the elliptical loop; and a reference electrode disposed outside the dielectric channel at a location along a direction substantially normal to a plane including major and minor axes of the loop.

3. Ion-forming apparatus including an ionizing electrode comprising:

a conductive filament forming the ionizing electrode configured as an elliptical loop devoid of conductive elements within the loop;

a support for the filament including a conductive connection thereto for applying high ionizing voltage;

a dielectric channel including walls surrounding the conductive filament for confining a stream of flowing gas about the filament in a direction substantially aligned with a major axis of the elliptical loop; and a reference electrode disposed outside the dielectric channel that forms at least a portion of a conductive ring disposed at a location adjacent the loop.

4. Ion-forming apparatus comprising:

a conductive filament configured as a loop having a planar portion;

a dielectric channel surrounding the conductive filament for confining a stream of flowing gas about the filament in substantial plane-parallel alignment with the planar portion, a distal end of the dielectric channel forming an orifice, and a distal extent of the loop filament being disposed at a selected position relative to the orifice; and a reference electrode disposed outside the dielectric channel oriented near the conductive filament for establishing an electric field between the conductive filament and the reference electrode in response to opposite polarities of ionizing voltage applied thereto.

5. Apparatus according to claim 4 in which the selected position of the distal extent of the loop filament is recessed relative to the orifice.

6. Apparatus according to claim 5 in which the loop of conductive filament is recessed from the orifice by not greater than 10 mm.

7. Apparatus according to claim 4 in which a cross-sectional profile of a flow of gas through the dielectric channel includes a region of maximum velocity substantially centrally within the dielectric channel; and the loop of conductive filament is supported within the dielectric channel with a planar portion of the loop substantially plane-parallel aligned with a flow of gas through the dielectric channel at a position substantially within said region of maximum velocity.

8. Apparatus according to claim 7 in which the planar portion of the loop of conductive filament orients an electric field of minimum intensity within the loop and of maximum intensity between the loop and reference electrode in response to high ionizing voltage applied thereto.

9. Apparatus according to claim 4 including a plural number of dielectric channels, each surrounding a loop of conductive filament and each communicating with a supply of gas under pressure for flowing a stream of gas about the loop of conductive filament; and supplies of high ionizing voltages of one and opposite polarities connected to one and another of the loop electrodes supported within one and another of the plural number of dielectric channels.

10. Apparatus according to claim 9 in which each of the dielectric channels includes a distal end forming an orifice, and each of the loop electrodes including a distal extent positioned within a dielectric channel at a position recessed from the associated orifice.

11. Apparatus according to claim 10 in which the distal extents of loop electrodes are positioned at different recessed spacing, relative to the associated orifices of one and another of the plural number of dielectric channels.

12. Apparatus according to claim 4 in which each of one and another of the plural number of dielectric channels communicates with a supply of a different gas under pressure; and at least one loop electrode is connected to AC high voltage power supply operable at a selected voltage and frequency.

13. Apparatus including an ionizing electrode comprising a conductive filament configured as an elliptical loop;

a support for the filament including a conductive connection thereto for applying high ionizing voltage;

a dielectric channel including walls surrounding the conductive filament for confining a stream of flowing gas about the filament with a major axis of the elliptical loop substantially aligned with a flow of gas through the channel;

a tubular element having walls disposed about the dielectric channel for confining a flow of gas through the tubular element, and for positioning a reference electrode thereabout;

a supply of a first gas under pressure communicating with at least one of the dielectric channel and tubular element for flowing a stream of the first gas therethrough; and another supply of a second gas under pressure communicating with another of the dielectric channel and tubular element for flowing a stream of the second gas therethrough.

14. Apparatus according to claim 13 in which the flows of the first and second gases are at different rates; and at least one of gases is an inert gas.

15. A method for delivering a stream of ions to a charged object, comprising:

establishing a stream of a flowing gas through a dielectric channel from a source of the gas at elevated pressure, the stream having a cross-sectional profile of velocity across the stream having a maximum velocity substantially in a central portion of the channel;

positioning a loop of conductive filament substantially within the central portion of the stream flowing within the channel with a planar portion of the loop oriented in substantial alignment with the stream of flowing gas and with the loop of conductive filament positioned to align a planar portion thereof exhibiting minimum of electric field intensity within the loop in response to voltage applied to the conductive filament substantially with the maximum velocity of gas flow through the dielectric channel; and applying high ionizing voltage to the conductive filament.

16. A method for delivering a stream of ions to a charged object, comprising:

establishing a stream of a flowing gas through a dielectric channel from a source of the gas at elevated pressure, the stream having a cross-sectional profile of velocity across the stream having a maximum velocity substantially in a central portion of the channel;

positioning a loop of conductive filament substantially within the central portion of the stream flowing within the channel with a planar portion of the loop oriented in substantial alignment with the stream of flowing gas, the dielectric channel surrounding the loop of conductive filament to confine the stream of flowing gas thereabout, with a distal extent of the loop of conductive filament recessed within the distal end of the dielectric channel and with a reference electrode disposed outside the dielectric channel near the location of the loop of conductive filament; and applying high ionizing voltage to the conductive filament.

17. A method for delivering a stream of ions, comprising:

establishing a stream of a flowing gas having a cross-sectional profile of velocity across the stream;

positioning a loop of conductive filament within the stream with an axis of the loop oriented in substantial alignment with the stream of flowing gas;

surrounding the conductive filament with one dielectric channel to confine the stream of flowing gas thereabout with a distal extent of the conductive filament selectively positioned relative to a distal end of the dielectric channel within a range of protrusion from, to recess within, the distal end of the dielectric channel;

establishing a plurality of dielectric channels each including a loop of conductive filament therein, in which different gases flow through said one and another of the plural number of dielectric channels; and applying high ionizing voltages of one and opposite polarities, respectively to the conductive filaments within said one and said another of the plural number of dielectric channels.

* * * * *